US010515753B2

(12) United States Patent
Min

(10) Patent No.: US 10,515,753 B2
(45) Date of Patent: Dec. 24, 2019

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventor: Byung Seung Min, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 114 days.

(21) Appl. No.: 15/478,584

(22) Filed: Apr. 4, 2017

(65) Prior Publication Data

US 2018/0019050 A1 Jan. 18, 2018

(30) Foreign Application Priority Data

Jul. 14, 2016 (KR) ..... 10-2016-0089352

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 41/12*** | (2006.01) |

(52) U.S. Cl.

CPC ..... *H01F 27/2804* (2013.01); *H01F 27/323* (2013.01); *H01F 41/041* (2013.01); *H01F 41/122* (2013.01); *H01F 2027/2809* (2013.01)

(58) Field of Classification Search

CPC ..... H01F 27/2804; H01F 27/323
USPC ..... 336/200, 232
See application file for complete search history.

(56) References Cited

U.S. PATENT DOCUMENTS

| | | | | |
|---|---|---|---|---|
| 7,955,942 | B2 * | 6/2011 | Pagaila | H01L 23/49822 257/531 |
| 2013/0038418 | A1 * | 2/2013 | Yang | H01F 5/00 336/200 |
| 2014/0240072 | A1 * | 8/2014 | Lan | H01F 27/2804 336/200 |
| 2014/0333406 | A1 | 11/2014 | Yang et al. | |
| 2015/0048918 | A1 | 2/2015 | Park et al. | |

(Continued)

FOREIGN PATENT DOCUMENTS

| | | | |
|---|---|---|---|
| KR | 10-2014-0132105 | A | 11/2014 |
| KR | 20140137306 | A * | 12/2014 |

(Continued)

*Primary Examiner* — Tszfung J Chan
(74) *Attorney, Agent, or Firm* — Morgan, Lewis & Bockius LLP

(57) ABSTRACT

A coil component includes a substrate and a coil portion disposed on at least one surface thereof. The coil portion includes a first coil pattern disposed on one surface of the substrate, a first insulating layer covering the first coil pattern and having a first surface facing the substrate and a second surface opposing the first surface, and an intermediate layer including third and fourth surfaces opposing each other, the third surface being disposed to face the second surface of the first insulating layer, and average surface roughness of the fourth surface being lower than that of the second surface. The coil portion further includes a second coil pattern disposed on the fourth surface of the intermediate layer and connected to the first coil pattern through a conductive via, and a second insulating layer disposed in a space between the fourth surface and the second coil pattern.

6 Claims, 5 Drawing Sheets

(56) References Cited

U.S. PATENT DOCUMENTS

2015/0187488 A1* 7/2015 Williams ..... H05K 3/061
336/192
2015/0296621 A1* 10/2015 Yosui ..... H01G 4/40
361/270

FOREIGN PATENT DOCUMENTS

KR 10-2015-0019588 A 2/2015
WO WO-2014115433 A1 * 7/2014 ..... H01F 17/0013

* cited by examiner

COIL COMPONENT AND METHOD OF MANUFACTURING THE SAME

CROSS-REFERENCE TO RELATED APPLICATION(S)

This application claims benefit of priority to Korean Patent Application No. 10-2016-0089352 filed on Jul. 14, 2016 in the Korean Intellectual Property Office, the disclosure of which is incorporated herein by reference in its entirety.

BACKGROUND

1. Field

The present disclosure relates to a coil component and a method of manufacturing the same.

2. Description of Related Art

An inductor, a type of electronic component, is a representative passive element or coil component commonly used to form an electronic circuit together with a resistor and a capacitor to remove noise. The inductor may be combined with such a capacitor using electromagnetism to provide a resonance circuit amplifying a signal in a specific frequency band, a filter circuit, or the like.

Recently, in view of miniaturizing and thinning information technology (IT) devices such as communications devices, display devices, and the like, research has been conducted into miniaturizing and thinning various elements such as inductors, capacitors, transistors, and the like, employed in the above-mentioned IT devices.

According to a conventional method for manufacturing a coil of an inductor, a coil is formed by winding a copper wire or using a plating method.

The method of winding a copper wire inductor (hereinafter, referred to as "wound-type" inductor) has advantages in that a high capacity inductor may be implemented and the process is simple. However, the method has a problem with regard to reductions in the size of the inductor.

In contrast, when the coil is formed by using the electroplating method, there are advantages in that a component having a small size may be implemented, and an inductor having capacity as high as that of the wound-type inductor may be manufactured.

However, according to the method for manufacturing a coil component using an electroplating method, an aspect ratio of the coil should be increased to secure high capacity inductance. However, current plating and circuit forming technologies have limitations in implementing a coil having the above-mentioned high aspect ratio.

Therefore, the technical limitations of the coil component may be solved by implementing the coil component in multilayer form using a lamination technique to have characteristics similar to the case in which the coil has the high aspect ratio.

SUMMARY

An aspect of the present disclosure may provide a coil component having a structure capable of securing high capacity inductance such as a coil having a high aspect ratio by implementing a coil having multiple layers using a lamination technique, and suppressing a non-uniform formation of a coil pattern caused by non-uniform development for a lower portion of the coil pattern by excessive exposure and development when multilayer coils are laminated.

An aspect of the present disclosure may also provide a method for manufacturing a coil component that may efficiently obtain the coil component.

According to an aspect of the present disclosure, a coil component may include a substrate and a coil portion disposed on at least one surface of the substrate. The coil portion includes a first coil pattern having a spiral shape disposed on one surface of the substrate; a first insulating layer encapsulating the first coil pattern; an intermediate layer disposed on a surface of the first insulating layer facing away from the substrate and having average surface roughness Ra of a surface facing the first insulating layer lower than average surface roughness Ra of a surface of the first insulating layer facing away from the substrate; a second coil pattern having a spiral shape disposed on a surface of the intermediate layer facing away from the first insulating layer and connected to the first coil pattern through a conductive via; and a second insulating layer disposed in a space between the surface of the intermediate layer facing away from the first insulating layer and the second coil pattern of the spiral shape.

According to another aspect of the present disclosure, a coil component may include a substrate, and a coil portion disposed on at least one surface of the substrate and having a layer structure. The coil portion includes a first coil pattern having a spiral shape disposed on a first layer of the coil portion and a first insulating layer encapsulating the first coil pattern; an intermediate layer disposed on an n-th layer of the coil portion, where n is an even number and where the intermediate layer has an average surface roughness Ra of a surface which is in contact with an n+1-th layer lower than an average surface roughness Ra of a surface which is in contact with an n−1-th layer; and a second coil pattern having a spiral shape disposed on an m-th layer of the coil portion, where m is an odd number other than 1, and connected to an adjacent coil pattern through a conductive via, and a second insulating layer disposed in a space between the second coil patterns having the spiral shape.

According to another aspect of the present disclosure, a coil component may include a substrate and a coil portion disposed on at least one surface of the substrate. The coil portion includes a first coil pattern having a spiral shape disposed on one surface of the substrate; a first insulating layer covering the first coil pattern and having a first surface facing the substrate and a second surface opposing the first surface; an intermediate layer including a third surface and a fourth surface opposing each other, the third surface being disposed to face the second surface of the first insulating layer, and average surface roughness of the fourth surface being lower than average surface roughness of the second surface; a second coil pattern having a spiral shape disposed on the fourth surface of the intermediate layer and connected to the first coil pattern through a conductive via; and a second insulating layer disposed on the fourth surface of the intermediate layer in a space between windings of the second coil pattern.

According to another aspect of the present disclosure, a coil component may include a substrate, and a coil portion disposed on at least one surface of the substrate and having a layer structure. The coil portion includes: a first coil pattern having a spiral shape disposed on a first layer of the coil portion and a first insulating layer encapsulating the first coil pattern; an intermediate layer disposed on an n-th layer of the coil portion, where n is an even number and where the intermediate layer has average surface roughness Ra of a surface which is in contact with an n+1-th layer lower than average surface roughness Ra of a surface which is in contact with an n−1-th layer; and a second coil pattern having a spiral shape disposed on an m-th layer of the coil portion, where m is an odd number other than 1, and connected to an adjacent coil pattern through a conductive via, and a second insulating layer disposed in a space between the second coil patterns having the spiral shape.

According to another aspect of the present disclosure, a method for manufacturing a coil component may include preparing a substrate, forming a first coil pattern on the substrate, and forming a first insulating layer covering the first coil pattern and having a first surface facing the substrate and a second surface opposing the first surface. The method further includes forming an intermediate layer on the second surface of the first insulating layer and having third and fourth surfaces opposing each other, the third surface being disposed to face the second surface of the first insulating layer, and forming a second insulating layer on the fourth surface of the intermediate layer. A via penetrating through the second insulating layer and the intermediate layer is formed, and a portion of the second insulating layer is removed to forma space having a shape corresponding to a second coil pattern having a spiral shape. The second coil pattern is formed in the space.

According to a further aspect of the present disclosure, a method for manufacturing a coil component includes forming a first intermediate layer overlaying a first coil pattern of the coil component, the first intermediate layer having first and second surfaces opposing each other, and the first surface facing away from the first coil pattern having a lower average surface roughness Ra than the second surface facing the first coil pattern. Following the forming of the first intermediate layer, a second coil pattern is formed on the first surface of the first intermediate layer facing away from the first coil pattern and having the lower average surface roughness Ra.

According to a further aspect of the present disclosure, a method for manufacturing a coil component includes forming an insulating layer having a spiral-shaped space therein on a surface of a first intermediate layer. A coil pattern is formed on the surface of the first intermediate layer in the spiral-shaped space of the insulating layer. One of a second intermediate layer and a cover layer is formed on surfaces of the insulating layer and the coil pattern facing away from the first intermediate layer.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Coil Component

Figure 1:
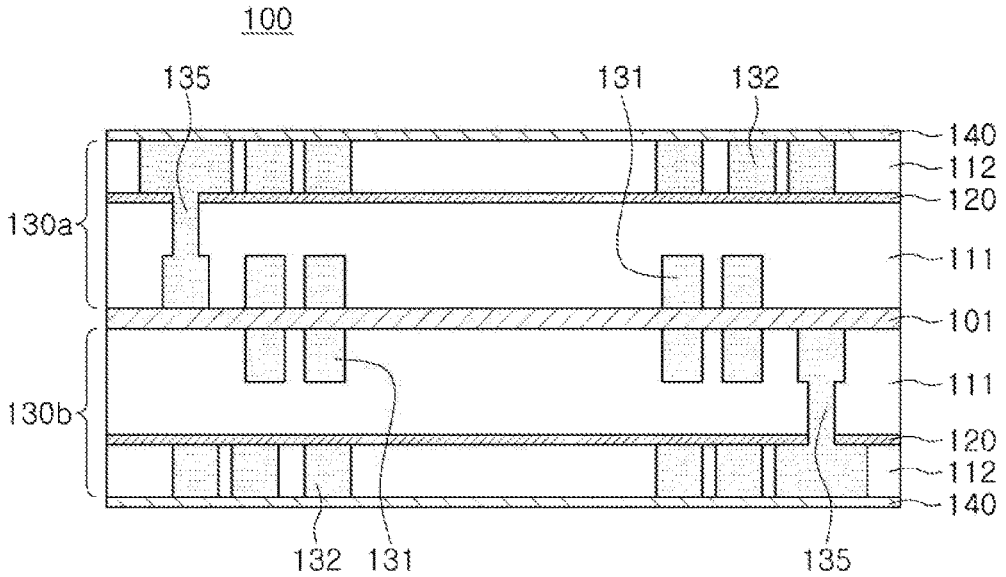
FIG. 1 schematically illustrates a cross-sectional view of a coil component according to an exemplary embodiment.

FIG. 1 schematically illustrates a cross-sectional view of a coil component 100 according to an exemplary embodiment.

Referring to FIG. 1, the coil component 100 according to an exemplary embodiment may include a substrate 101 and coil portions 130*a* and 130*b*.

The coil portions 130*a* and 130*b* may be formed on one surface of the substrate 101, or may be formed on both surfaces of the substrate 101, as needed.

In the case in which the coil portions 130*a* and 130*b* are formed on both surfaces of the substrate 101, coils disposed on both surfaces of the substrate 101 may be electrically connected to each other through a conductive via (not shown) that penetrates through the substrate 101.

The substrate 101 may be a plate-type support member having strength capable of supporting the coil.

In order to improve inductance characteristics of the coil component 100, the substrate 101 may be formed using a plate-type support member formed of a magnetic material. For example, in order to make the flow of magnetic flux smooth, the substrate 101 may be formed of Ni—Zn, a Nn—Zn based ferrite, a Mi—Zn based ferrite, a Ni—Zn—Mg based ferrite, a Mn—Mg—Zn based ferrite, or a compound thereof that has high electrical resistance and low magnetic force loss.

Hereinafter, a structure in which the coil portion 130*a* is disposed on only one surface of the substrate 101 will be described for clarity of explanation. However, the present disclosure is not limited to the case in which the coil portion 130*a* is disposed on only one surface of the substrate 101, and in the case in which the coil portions 130*a* and 130*b* are disposed on both surfaces of the substrate 101, the coil portion 130*b* disposed on the other surface of the substrate 101 (relative to one surface on which the coil portion 130*a* is disposed) may have the same configuration as that of the coil portion 130*a* disposed on the one surface of the substrate 101.

A first coil pattern 131 may be disposed on one surface of the substrate 101. The first coil pattern 131 may be formed in a spiral shape, and may be formed in a quadrangular spiral or a circular spiral, but is not limited thereto.

The first coil pattern 131 may be formed by using a plating method, or using a conductive paste, but is not limited thereto.

The first coil pattern 131 may include any one selected from the group consisting of copper (Cu), gold (Au), silver (Ag), aluminum (Al), and nickel (Ni), or an alloy thereof.

The portions of the first coil pattern 131 except for the conductive via 135 may be encapsulated by a first insulating layer 111.

That is, the first insulating layer 111 may be disposed on one surface of the substrate 101 to cover the first coil pattern 131.

The first insulating layer 111 may have a first surface facing and contacting the substrate 101, and a second surface opposing the first surface and facing away from the substrate 101.

The first insulating layer 111 may serve to prevent a short circuit between a second coil pattern 132 to be described below and the first coil pattern 131.

The first insulating layer 111 may be formed of a photosensitive insulating material, but is not limited thereto.

The photosensitive insulating material refers to a resin that causes a chemical change when light is irradiated thereto, and means a material that reacts with light having a specific wavelength to cause a change such as dissolution, coagulation, or the like.

That is, when the photosensitive insulating material is exposed to the light having the specific wavelength band, a chain of the polymer of the exposed portion may be disconnected, or more strongly bonded.

The photosensitive insulating material may be classified into a negative type in which the polymer of the exposed portion becomes insoluble for specific chemicals and a positive type in which the exposed portion becomes soluable for the specific chemicals in contrast to the negative type.

The negative type photosensitive insulating material may include aromatic bis-azide, methacrylic acid ester, cinnamic acid aster, and the like, and the positive type photosensitive insulating material may include polymethacrylic acid methyl, naphthoquinone diazide, polybutene-1-sulfone, and the like.

An intermediate layer 120 may be disposed on a surface of the first insulating layer 111 facing away from the substrate 101 (e.g., the second surface).

The intermediate layer 120 may have third and fourth surfaces opposing each other, and the third surface may be disposed to face (and contact) the second surface of the first insulating layer 111. That is, the second surface of the first insulating layer 111 and the third surface of the intermediate layer 120 may be in contact with each other.

Average surface roughness Ra of a surface of the intermediate layer 120 facing away from the first insulating layer 111 (e.g., the fourth surface) may be lower than average surface roughness Ra of a surface of the first insulating layer 111 facing away from the substrate 101 (e.g., the second surface). That is, the average surface roughness Ra of the fourth surface of the intermediate layer 120 may be lower than the average surface roughness Ra of the second surface of the first insulating layer 111.

In addition, unevenness of the surface of the intermediate layer 120 facing away from the first insulating layer 111 (e.g., the fourth surface) may be lower than unevenness of the surface of the first insulating layer 111 facing away from the substrate 101 (e.g., the second surface). That is, the unevenness of the fourth surface of the intermediate layer 120 may be lower than the unevenness of the second surface of the first insulating layer 111.

In accordance with the conventional coil component, in a case in which there is no intermediate layer 120 used while forming a multilayer coil, there is a problem that the coil patterns of the second and further coil layers (formed after the formation of base coil layer of the multilayer coil) are non-uniformly formed because lower surfaces of the coil patterns of the second and further layers are non-uniform in the multilayer coil.

However, in the coil component according to the exemplary embodiment described herein, because the intermediate layer 120 is disposed on the surface of the first insulating layer 111 facing away from the substrate 101 (e.g., the second surface), that is, on the surface of the first insulating layer 111 on which the second coil pattern 132 would be disposed if no intermediate layer 120 was used, and because the second coil pattern 132 is disposed on the intermediate layer 120, the coil patterns 131 and 132 may be uniformly formed.

The intermediate layer 120 may be formed by spin-coating a polymer resin having low viscosity or a liquid polymer resin.

Alternatively, the intermediate layer 120 is formed, and the surface of the intermediate layer 120 facing away from the first insulating layer 111 (e.g., the fourth surface), that is, the surface of the intermediate layer 120 on which the second coil pattern 132 is disposed, is surface-treated by a chemical-physical method, such that the average surface roughness Ra of the surface of the intermediate layer 120 facing away from the first insulating layer 111 (e.g., the fourth surface) may be lower than the average surface roughness Ra of the surface of the first insulating layer 111 facing away from the substrate 101 (e.g., the second surface).

The second coil pattern 132 and a second insulating layer 112 may be disposed on the surface of the intermediate layer 120 facing away from the first insulating layer 111 (e.g., on the fourth surface). That is, the second coil pattern 132 and the second insulating layer 112 may be disposed on the fourth surface of the intermediate layer 120.

The second coil pattern 132 may be formed by using a plating method.

The second coil pattern 132 may include any one selected from the group consisting of copper (Cu), gold (Au), silver (Ag), aluminum (Al), and nickel (Ni), or an alloy thereof.

The second coil pattern 132 may be electrically connected to the first coil pattern 131 through the conductive via 135 to form one coil.

The second insulating layer 112 may be formed of a photosensitive insulating material.

In the case in which the second insulating layer 112 is formed of the photosensitive insulating material, the second insulating layer 112 formed of the photosensitive material may be formed on the surface of the intermediate layer 120 facing away from the first insulating layer 111 (e.g., the fourth surface). Thereafter, the second insulating layer 112 of a region corresponding to the second coil pattern 132 may be removed by exposure and development operations, and the second coil pattern 132 may be formed to be connected to the conductive via 135 using an electroplating method or an electroless plating method to form the second coil pattern having a spiral shape.

In this case, the intermediate layer 120 may serve as an etching passivation layer. That is, in the exposure and development operations of the second insulating layer 112, the intermediate layer 120 may serve to prevent the etching of the first insulating layer 111.

As a result, the second insulating layer 112 may be disposed between the second coil patterns 132.

A cover layer 140 for insulating the second insulating layer 112 and the second coil pattern 132 from the external environment may be disposed on the second insulating layer 112 and on a surface of the second coil pattern 132 facing away from the intermediate layer 120.

Figure 2:
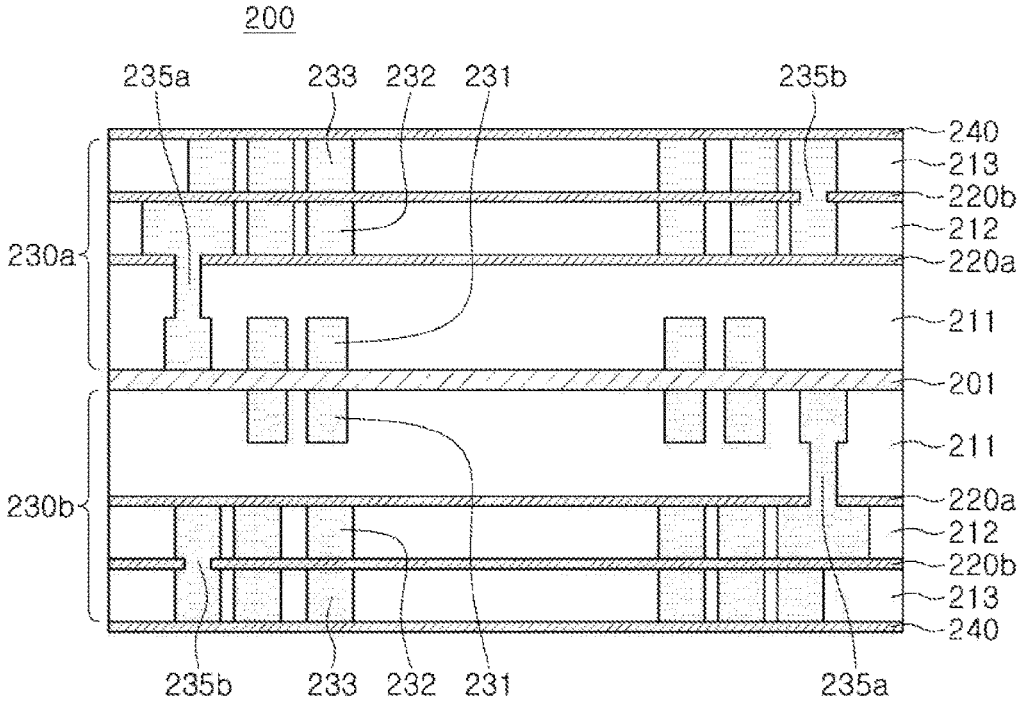
FIG. 2 schematically illustrates a cross-sectional view of a coil component according to another exemplary embodiment.

FIG. 2 schematically illustrates a cross-sectional view of a coil component 200 according to another exemplary embodiment.

For clarity of explanation, a description of the same configurations as those of the coil component 100 according to the exemplary embodiment described above will be omitted.

Referring to FIG. 2, the coil component 200 according to another exemplary embodiment may include a substrate 201 and coil portions 230*a* and 230*b* disposed on at least one surface of the substrate 201.

The coil portions 230*a* and 230*b* may have a layer structure, and may be disposed on one surface or both surfaces of the substrate 201.

A first coil pattern 231 of a spiral shape and a first insulating layer 211 encapsulating the first coil pattern 231 may be disposed on the surfaces of the substrate 201 as first layers of the coil portions 230*a* and 230*b*.

Intermediate layers 220*a* and 220*b* may be disposed on n-th layers (where n is an even number) of the coil portions 230*a* and 230*b*.

Average surface roughness Ra of surfaces of the intermediate layers 220*a* and 220*b* which are in contact with n+1-th layers (e.g., surfaces of the intermediate layers 220*a* and 220*b* facing away from the substrate 201) may be lower than average surface roughness Ra of surfaces of the intermediate layers 220*a* and 220*b* which are in contact with n−1-th layers (e.g., surfaces of the intermediate layers 220*a* and 220*b* facing the substrate 201).

Alternatively, unevenness of the surfaces of the intermediate layers 220*a* and 220*b* which are in contact with the n+1-th layers (e.g., surfaces of the intermediate layers 220*a* and 220*b* facing away from the substrate 201) may be lower than unevenness of the surfaces of the intermediate layers 220*a* and 220*b* which are in contact with the n−1-th layers (e.g., surfaces of the intermediate layers 220*a* and 220*b* facing the substrate 201).

Second coil patterns 232 and 233 of a spiral shape which are connected to adjacent coil patterns through conductive vias 235*a* and 235*b* may be disposed on m-th layers (where m is an odd number other than 1) of the coil portions 230*a* and 230*b*. In addition, second insulating layers 212 and 213 may be disposed between the second coil patterns 232 and 233 of the spiral shape on the m-th layers (where m is an odd number other than 1) of the coil portions 230*a* and 230*b*.

Cover layers 240 may be disposed on the coil portions 230*a* and 230*b* to serve to protect the coil from the external environment.

Method for Manufacturing Coil Component

Figure 3:
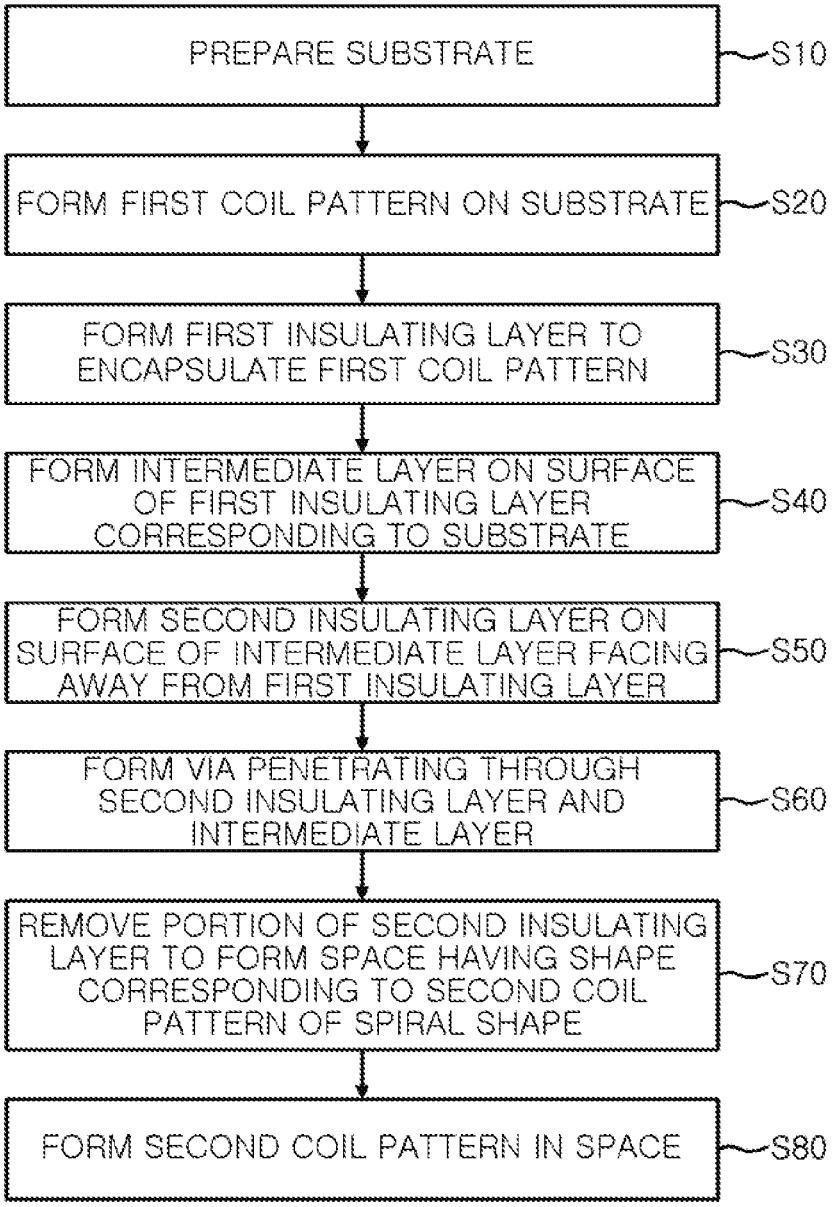
FIG. 3 is a flowchart schematically illustrating a method for manufacturing a coil component according to the other exemplary embodiment.

FIG. 3 is a flowchart schematically illustrating a method for manufacturing a coil component according to another exemplary embodiment and FIGS. 4 through 10 schematically illustrate the respective steps or operations of the method for manufacturing a coil component according to the other exemplary embodiment.

Hereinafter, a method for manufacturing a coil component according to the other exemplary embodiment will be described with reference to FIGS. 3 and 4 through 10.

Figure 4:
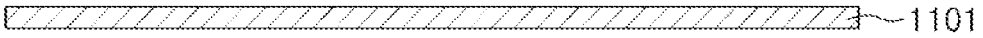
FIGS. 4 through 10 schematically illustrate the respective steps or operations of the method for manufacturing a coil component according to the other exemplary embodiment.

First, as illustrated in FIG. 4, an operation (S10) of preparing a substrate 1101 may be performed.

The substrate 1101 may be a plate-type support member having strength capable of supporting the coil.

In order to improve inductance of the coil component, the substrate 1101 may be formed of the plate-type support member formed of a magnetic material. For example, in order to make the flow of magnetic flux smooth, the substrate 1101 may be formed of a Ni—Zn based ferrite, Ni—Zn, a Mn—Zn based ferrite, a Ni—Zn based ferrite, a Ni—Zn—Mg based ferrite, a Mn—Mg—Zn based ferrite, or a compound thereof that has high electrical resistance and low magnetic force loss.

Figure 5:
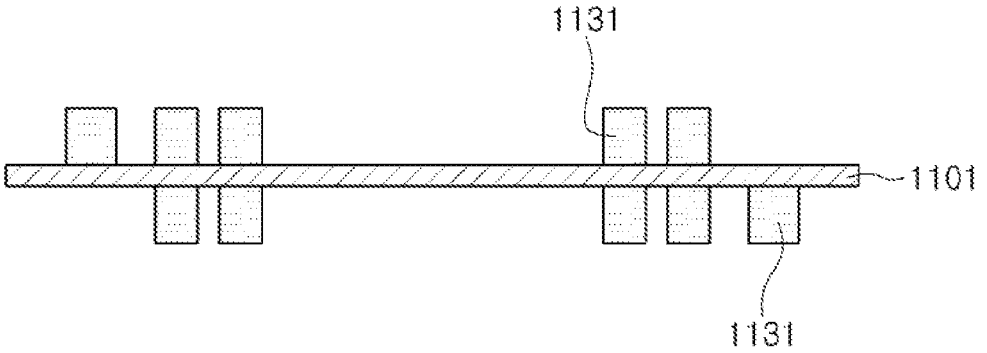

Next, as illustrated in FIG. 5, an operation (S20) of forming a first coil pattern 1131 on one surface or both surfaces (as shown) of the substrate 1101 may be performed.

The first coil pattern 1131 may be formed in a spiral shape, and may be formed in a quadrangular spiral or a circular spiral, but is not limited thereto.

The first coil pattern 1131 may be formed by using a plating method, or using a conductive paste, but is not limited thereto.

The first coil pattern 1131 may include any one selected from the group consisting of copper (Cu), gold (Au), silver (Ag), aluminum (Al), and nickel (Ni), or an alloy thereof.

In the case in which first coil patterns 1131 are formed on both surfaces of the substrate 1101, a conductive via (not shown) may be formed in the substrate 1101 before forming the first coil patterns 1131 to connect the first coil patterns 1131 formed on opposite surfaces of the substrate 1101 to each other.

Figure 6:
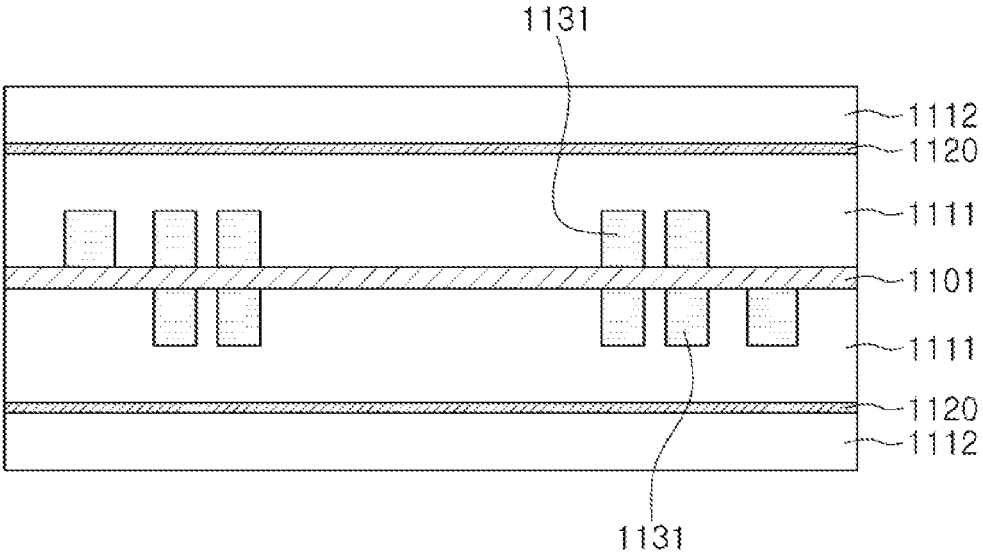

Next, as illustrated in FIG. 6, an operation (S30) of forming a first insulating layer 1111 to cover the first coil pattern 1131, an operation (S40) of forming an intermediate layer 1120 on a surface of the first insulating layer 1111 facing away from the substrate 1101, and an operation (S50) of forming a second insulating layer 1112 on a surface of the intermediate layer 1120 facing away from the first insulating layer 1111 may be sequentially performed.

That is, an insulating portion having a double structure in which the intermediate layer 1120 is disposed between the first and second insulating layers 1111 and 1112 may be formed.

The first insulating layer 1111 may have a first surface facing the substrate 1101 and a second surface opposing the first surface and facing away from the substrate 1101, and the intermediate layer 1120 may have a third surface facing the first insulating layer 1111 and a fourth surface opposing the third surface and facing away from the first insulating layer 1111.

The first insulating layer 1111 and the second insulating layer 1112 may be formed of a photosensitive insulating material.

According to the related art, in a case in which the coil patterns are formed by using the photosensitive insulating material, after the coil patterns are formed, the photosensitive insulating material is removed and the portion from which the photosensitive insulating material is removed is filled with another polymer insulating material. In the method for manufacturing a coil component according to an exemplary embodiment, however, the coil component may be completed without removing the second insulating layer 1112 after the second coil pattern 1132 is formed in the second insulating layer 1112, as described below.

The operation (S40) of forming the intermediate layer 1120 may further include an operation of surface-treating the fourth surface of the intermediate layer 1120 so that average surface roughness Ra of the fourth surface of the intermediate layer 1120 is lower than average surface roughness Ra of the second surface of the first insulating layer 1111.

The surface-treatment may be performed by a chemical or physical method.

Since the second coil pattern 1132 is formed on one surface of the intermediate layer 1120 (e.g., on the fourth surface) as will be described below, the second coil pattern 1132 may be uniformly formed by surface-treating the surface of the intermediate layer 1120 facing away from the first insulating layer 1111 (e.g., the fourth surface) so that the average surface roughness Ra of the surface of the intermediate layer 1120 facing away from the first insulating layer 1111 (e.g., the fourth surface) is lower than the average surface roughness Ra of the surface of the first insulating layer 1111 facing away from the substrate 1101 (e.g., the second surface).

In this case, the surface treatment may be performed so that unevenness of the surface of the intermediate layer 1120 facing away from the first insulating layer 1111 (e.g., the fourth surface) is lower than unevenness of the surface of the first insulating layer 1111 facing away from the substrate 1101 (e.g., the second surface).

Unlike this, in the operation (S40) of forming the intermediate layer 1120, the intermediate layer 1120 may be formed by spin-coating a polymer resin having low viscosity. In the case in which the spin coating is performed, the average surface roughness Ra of the surface of the intermediate layer 1120 facing away from the first insulating layer 1111 may be lower than the average surface roughness Ra of the surface of the first insulating layer 1111 facing away from the substrate 1101 (e.g., the second surface) without performing a separate surface treatment operation. In this case, the spin coating may be performed so that the unevenness of the surface of the intermediate layer 1120 facing away from the first insulating layer 1111 is lower than the unevenness of the surface of the first insulating layer 1111 facing away from the substrate 1101.

Figure 7:
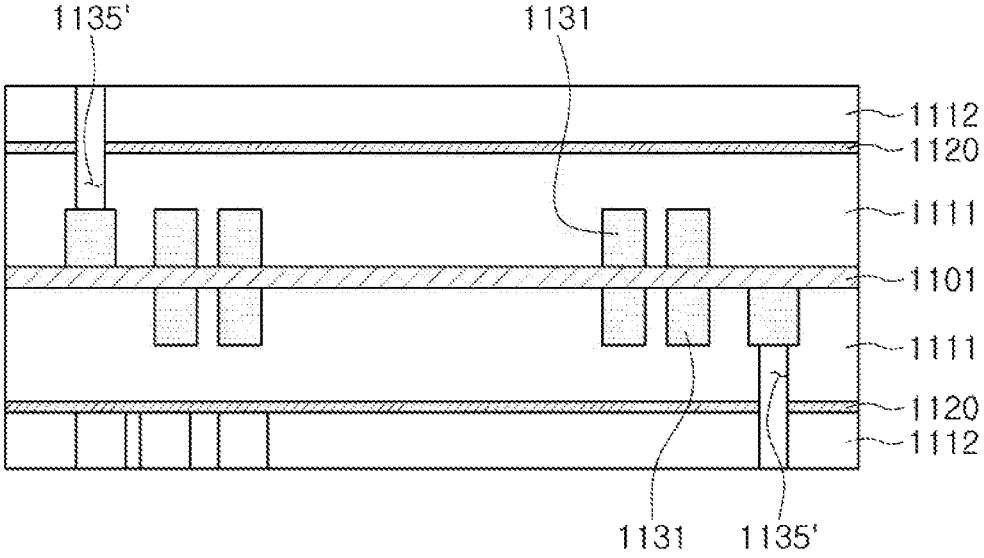

Next, as illustrated in FIG. 7, after the second insulating layer 1112 is formed, a via hole 1135' may be formed by using laser etching or the like (S60). The via hole 1135' may be filled with a conductive material to electrically connect the first coil pattern 1131 and the second coil pattern 1132 to each other.

Figure 8:
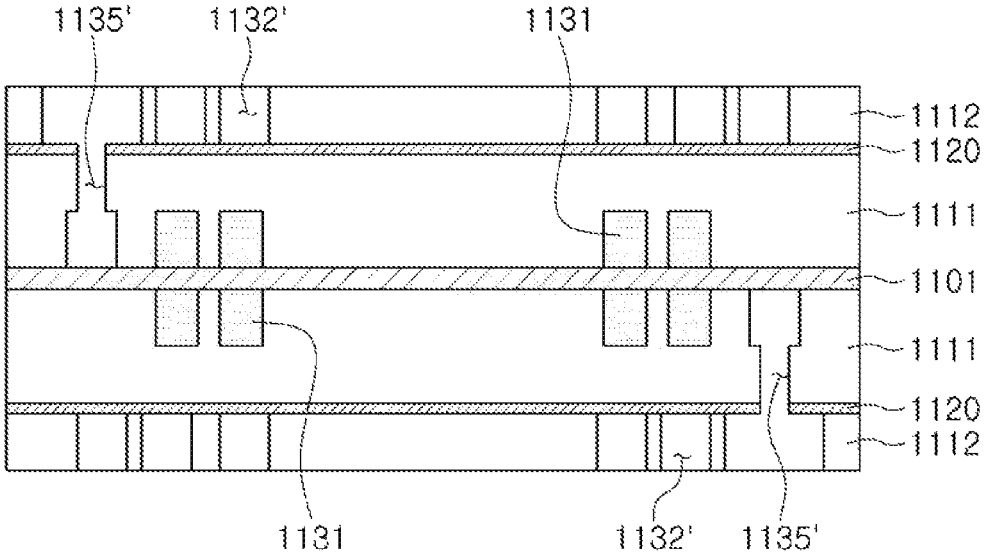

Next, as illustrated in FIG. 8, an operation (S70) of exposing and developing the second insulating layer 1112 by using a mask and removing a portion of the exposed and developed second insulating layer 1112 to form a space 1132' having a shape corresponding to the second coil pattern of the spiral shape may be performed.

Figure 9:
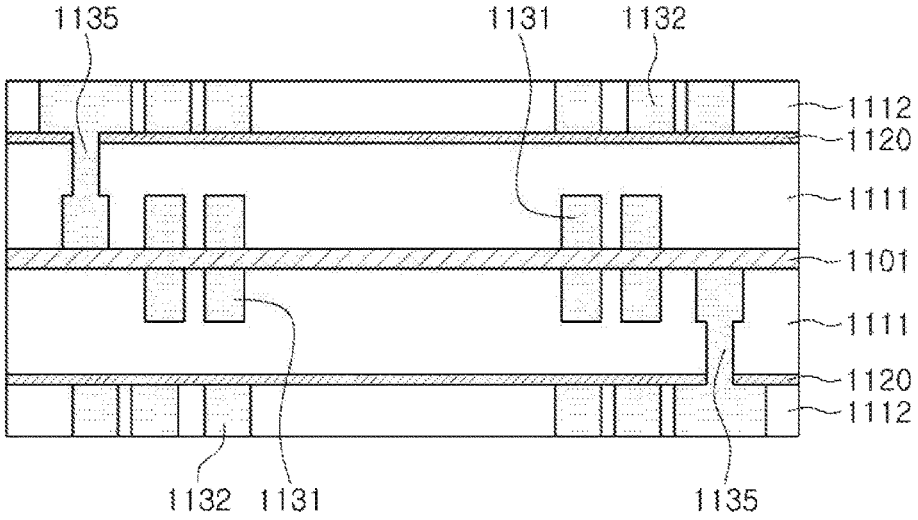

Next, as illustrated in FIG. 9, an operation (S80) of forming the second coil pattern 1132 in the space 1132' having the shape corresponding to the second coil pattern of the spiral shape may be performed.

The operation (S80) of forming the second coil pattern 1132 may be performed by using an electroplating method or an electroless plating method.

In the operation of forming the second coil pattern 1132 using the electroplating method or the electroless plating method, the via hole 1135' may be filled to form a conductive via 1135.

Figure 10:
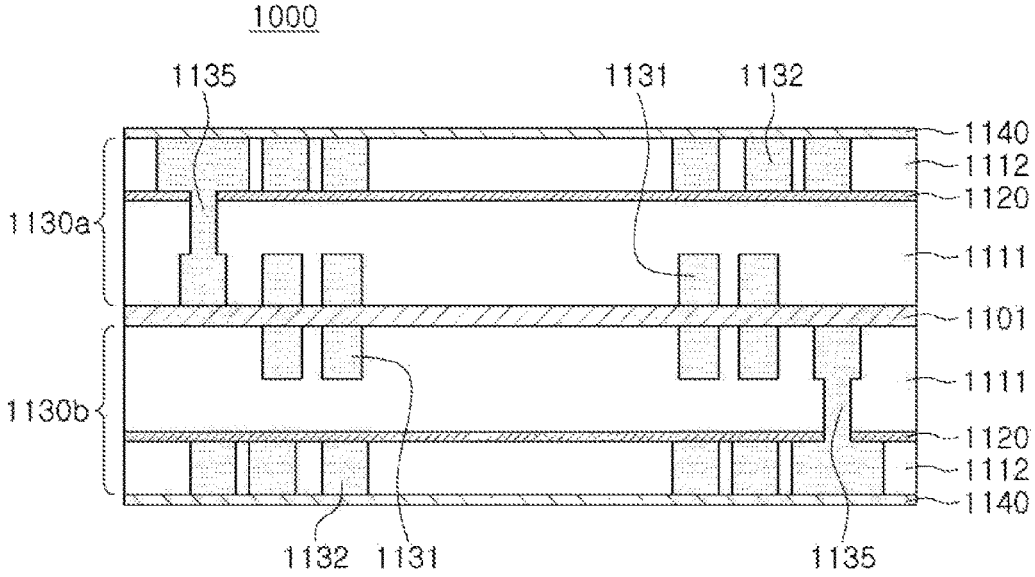

Finally, as illustrated in FIG. 10, a cover layer 1140 for insulating the second insulating layer 1112 and the second coil pattern 1132 from the external environment may be formed on the second insulating layer 1112 and a surface of the second coil pattern 1132 facing the intermediate layer 1120.

The method for manufacturing a coil component according to the other exemplary embodiment described above may have advantages in that it may provide a high capacity coil component, may particularly employ the photosensitive insulating material as an interlayer insulating material to replace a method for forming a coil pattern using a dry film according to the related art, and may further significantly reduce the number of operations required for manufacturing the coil component.

Further, since the coil component and the method for manufacturing the same according to the exemplary embodiments have the intermediate layer 1120, the coil pattern having a uniform shape may be formed at the time of forming the coil pattern disposed as the second layer or further layer among the coil patterns. Therefore, the coil component manufactured by the method for manufacturing the coil component according the exemplary embodiment may have an effect that the coil pattern is uniform and electrical characteristics thereof are uniform.

As set forth above, according to the exemplary embodiments, the coil component may secure the high capacity inductance such as the coil component having the high aspect ratio by implementing the coil having the multiple layers using the lamination technique, and may provide the structure in which the intermediate layer 1120 makes the surface of the insulating layer (e.g., 1111) uniform in the multilayer structure to form the coil pattern to be uniform.

While exemplary embodiments have been shown and described above, it will be apparent to those skilled in the art that modifications and variations could be made without departing from the scope of the present invention as defined by the appended claims.

What is claimed is:

1. A coil component comprising:

a substrate and a coil portion disposed on at least one surface of the substrate in a stacking direction, wherein the coil portion includes:

a first coil pattern having a spiral shape disposed on one surface of the substrate;

a first insulating layer covering the first coil pattern and having a first surface facing the substrate and a second surface opposing the first surface;

a first intermediate layer including a third surface and a fourth surface opposing each other, the third surface being disposed to face the second surface of the first insulating layer, and average surface roughness of the fourth surface being lower than average surface roughness of the second surface;

a second coil pattern having a spiral shape disposed on the fourth surface of the first intermediate layer and connected to the first coil pattern through a conductive via; and a second insulating layer disposed on the fourth surface of the first intermediate layer in a space between windings of the second coil pattern, and wherein the first intermediate layer is spaced apart from the first coil pattern, and the first insulating layer is arranged between the first coil pattern and the first intermediate layer in the stacking direction.

2. The coil component of claim 1, wherein unevenness of the fourth surface of the first intermediate layer is lower than unevenness of the second surface of the first insulating layer.

3. The coil component of claim 1, wherein the first or second insulating layer is formed of a photosensitive insulating material.

4. The coil component of claim 1, wherein the first intermediate layer is an etching passivation layer.

5. The coil component of claim 1, further comprising a cover layer disposed on the outermost layer of the coil portion to insulate the second coil pattern from the external environment.

6. The coil component of claim 1, wherein the coil portion further includes:

a third coil pattern having a spiral shape disposed on another surface of the substrate opposing the one surface;

a third insulating layer covering the third coil pattern and having a fifth surface facing the substrate and a sixth surface opposing the fifth surface;

a second intermediate layer including a seventh surface and an eighth surface opposing each other, the seventh surface being disposed to face the sixth surface of the third insulating layer, and average surface roughness of the eighth surface being lower than average surface roughness of the sixth surface;

a fourth coil pattern having a spiral shape disposed on the eighth surface of the second intermediate layer and connected to the third coil pattern through a conductive via; and a fourth insulating layer disposed on the eighth surface of the second intermediate layer in a space between windings of the fourth coil pattern.

* * * * *